United States Patent [19]

de Riz et al.

[11] 4,364,125

[45] Dec. 21, 1982

[54] STIFFENING INSERT FOR WEARING APPAREL

[75] Inventors: Erich de Riz, Heppenheim; Wolfgang Ringel, Rimbach, both of Fed. Rep. of Germany

[73] Assignee: Firma Carl Freudenberg, Weinheim, Fed. Rep. of Germany

[21] Appl. No.: 247,056

[22] Filed: Mar. 24, 1981

[30] Foreign Application Priority Data

Apr. 10, 1980 [DE] Fed. Rep. of Germany ..... 3013764

[51] Int. Cl.[3] ..... E03D 11/00

[52] U.S. Cl. ..... 2/255

[58] Field of Search ..... 2/134, 132, 220, 129, 2/123, 255

[56] References Cited

U.S. PATENT DOCUMENTS 2,756,435 7/1956 Rose ..... 2/255

3,075,202 1/1963 Rubio ..... 2/132

*Primary Examiner*—Doris L. Troutman

*Attorney, Agent, or Firm*—Kenyon & Kenyon

[57] ABSTRACT

A stiffening insert of shaped stiff material having openings parallel to the long axis of the material is disclosed. The openings present a serrated outline. The inserts may be applied to collars, cuffs, waist bands, clothes trim and other parts of apparel which need to be stiffened.

8 Claims, 3 Drawing Figures

STIFFENING INSERT FOR WEARING APPAREL

BACKGROUND OF THE INVENTION

The invention relates to a shape-determining stiffening insert for articles of wearing apparel which is formed from stiff material such as a bonded fabric having several openings running parallel to the long axis of the material.

A stiffening insert of a similar type is described in DE-OS No. 18 14 217. The openings of that insert are elongated and are separated from each other by relatively wide portions of insert material. Their use in light-weight outer garment materials is objectionable because these intermediate portions of insert material appear on the surface of the garment. Moreover, the actual location of the resultant folding crease is defined insufficiently, and it can be, for instance, near the left side or the right side of the openings. This does not make a very satisfactory visual appearance of the garment.

It is, therefore, an object of the invention to develop a stiffening insert in such a manner that the mentioned shortcomings are avoided and that, in particular, the location of the folding crease obtained is more precise and the appearance is made more uniform.

SUMMARY OF THE INVENTION

According to the invention, there is provided a stiffening insert of stiff, flat material having at least one series of internal openings parallel to the long axis of the insert wherein each opening is defined by a set of circular holes which overlap each other, and wherein the portions of insert material separating each opening have a width which is smaller than twice the diameter of the circular holes.

A preferred range of ratios of the circular hole diameter to the respective center distance between two adjacent holes in an opening is from about 1.05 to about 1.8.

An especially preferred radio of hole diameter to center distance is 1.4.

A preferred range of ratios of the width of the material portions between openings to the circular hole diameter is from about 0.6 to about 1.6.

BRIEF DESCRIPTION OF THE DRAWINGS

The stiffening insert of the invention is exemplified by the drawings but is not limited thereby. The drawings have a 10x scale; the holes forming the openings of each figure have a diameter of 2.0 mm and the width of the material portion between the openings is 1.4 mm.

In the drawings the bonded fabric is designated 1. The opening is designated 2; the diameter of the circular holes is designated D; the center to center distance of adjacent holes is designated T and the width of the portions of insert material between the openings is designated B.

DETAILED DESCRIPTION OF THE INVENTION

Figure 1:
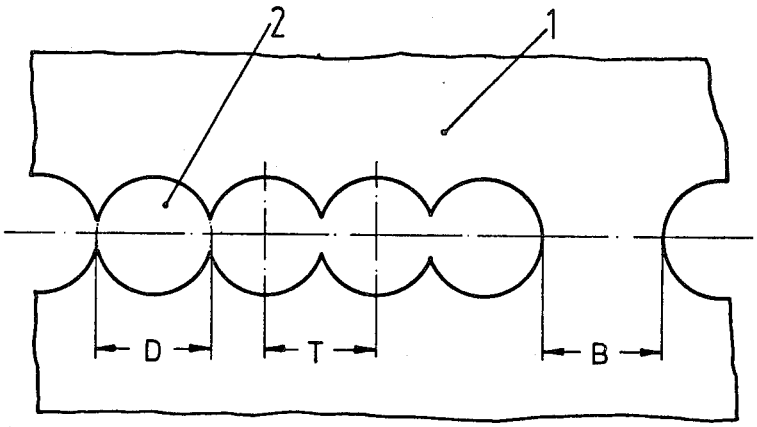
FIG. 1 shows a stiffening insert in which the ratio of the hole diameter to the respective center distance of two adjacent holes of an opening is 1.05.
Figure 2:
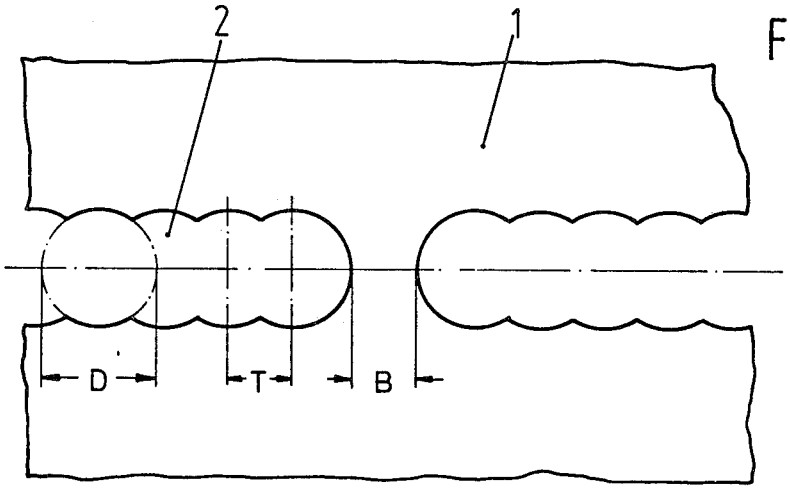
FIG. 2 shows a stiffening insert in which the ratio of the hole diameter to the center distance is 1.8.
Figure 3:
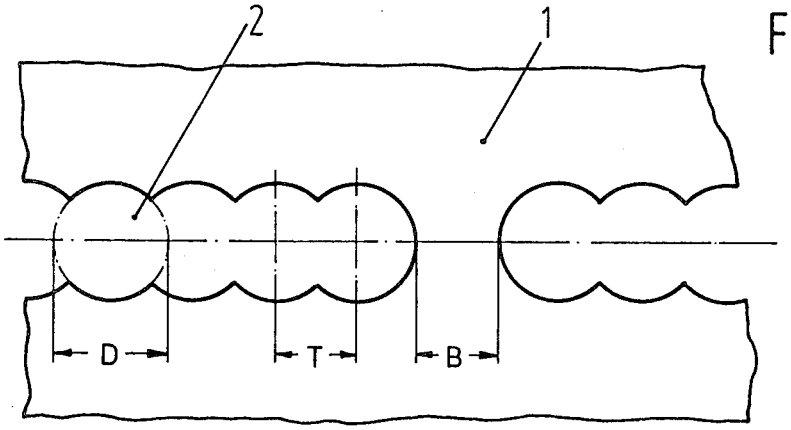
FIG. 3 shows a stiffening insert in which the ratio of the hole diameter to the center distance is 1.4.

The stiffening insert of the invention has openings which contrast with the uniform or straight outlines of the insert openings of the art, in that they have a serrated outline. The individual serrations are substantially slender lobes which have wide bases and taper to tips pointing to the long axis of the insert. Depending on the mutual distance between the tips, which are directly opposite each other, the stiffening force exerted on the attached garment material is diminished in the direction of the log axis of symmetry of the openings, and this axis becomes the center line of the folding line. It has been found with the insert of the invention that the position of the folding line is accurately maintained when the insert is used with very light outer materials such as dress shirt materials under difficult conditions, for instance, in the vicinity of the collar.

The defined fixation of the folding crease also favors particularly the folding behavior of the insert material portions between the openings. These portions no longer substantially show on the surface even when very light outer materials are used, and the folding edge obtained appears substantially straighter and uniform. Therefore, the stiffening insert of the invention allows in particular the manufacture of fashion dresses which are characterized by a soft, textile-like fall, by precise workmanship in the area of collars, waist bands and lapels as is often required, for instance, in ladies' outer wear such as in blouses and dresses.

It has been found that an especially good development of the folding crease occurs when the ratio of the circular hole diameter to the respective center distance of adjacent holes of an opening is from about 1.05 to about 1.8. Within this range, a small ratio, which will produce large lobes along the opening outline, is preferred for use in stiffening light-weight materials. A large ratio, which will produce small lobes along the opening outline, is suitable for stiffening relatively heavy materials such as suit materials. A ratio of 1.4 is preferred as universally applicable. It has been found that with a ratio of 1.4, more than 90% of materials and garments of interest, which are provided with stiffening inserts, develop an optimum location and appearance of folding creases. Neither the opening outlines nor the portions of insert material between the openings are substantially visible on the surface with light-weight grades of material.

In light weight material applications, a ratio smaller than 1.6 is preferred for the width of the portion of insert material between the openings to the diameter of the circular holes. A ratio greater than 0.6 is also preferred because below this ratio, the mechanical strength of some types of insert material is low enough to permit tearing of the portions between the openings during processing. A preferred range of lengths of material portions between openings is from about 10 to about 40 mm, depending on the strength of the stiffening insert material. A preferred range of diameters of the circular holes is from about 1.0 to about 3.0 mm, with a diameter of 2.0 mm being especially preferred.

Stiffening inserts of the invention are well suited for mechanized mass production of textiles. They can be used wherever the development of a precise folding crease is inportant, for instance, in making trim such as skirt or trouser waist bands and in making collars, sleeves or button strips. Use of the stiffening insert of the invention makes possible, in many applications, to join the trim of the type mentioned to the garment by a single sewing operation. Sewing-on the waist band of a ladies' skirt is a typical example. A stiffening insert of the invention with an adhesive backing and having three series of openings parallel to each other is ironed on the outer garment material. The outer garment material is then easily folded twice along the long axes of symmetry of two of the parallel series of openings in the stiffening insert. The stiffened waist band is pushed onto the upper edge of the ladies' skirt and joined to the latter by a single quilting seam. The waist band can subsequently be ironed over again, but it is basically considered as finished and requires no further operations therefor.

The material of stiffening inserts of the invention consists preferably of bonded fabric of natural or synthetic fibers which are cemented together autogenously or through the use of a secondary binder. The fibers may be directionally oriented, meaning that a major proportion of the fibers, preferably more than 70%, is oriented in a given direction. The stiffening insert of this construction has a greater stiffening effect along the fiber orientation axis than in a transverse direction. A directional stiffening effect of this type is important for example, when applying a stiffening insert to a sleeve or a waist band. The major stiffening force in this instance should be oriented in a transverse direction to the long axis of the openings.

We claim:

1. A stiffening insert for wearing apparel, which comprises: a stiff, flat material having an outline appropriate for the wearing apparel and having at least one series of internal multiple openings parallel to the long axis of the material, wherein each opening is defined by a set of circular holes which overlap each other, and wherein the portions of material between adjacent openings of a series have widths which are smaller than twice the diameter of the circular holes.

2. A stiffening insert according to claim 1 wherein the ratio of the diameter of the circular holes to the distance between the centers of adjacent holes of an opening is from about 1.05 to about 1.8.

3. A stiffening insert according to claim 2 wherein the ratio is 1.4.

4. A stiffening insert according to claim 1, 2 or 3 wherein the ratio of the width of the portion of material between openings to the diameter of the holes is from about 0.6 to about 1.6.

5. A stiffening insert according to claim 1 which further comprises material with an adhesive backing.

6. A stiffening insert according to claim 1 which further comprises material having two or more series of multiple openings parallel to the long axis of the material.

7. A stiffening insert according to claim 1 wherein the material has an outline appropriate for a shirt collar, shirt cuff or waist band.

8. A stiffening insert according to claim 1 wherein the material has a rectangular outline.

* * * * *